US010508403B2

(12) United States Patent
Teobaldelli

(10) Patent No.: US 10,508,403 B2
(45) Date of Patent: Dec. 17, 2019

(54) FOUNDATION

(71) Applicant: Ivan Teobaldelli, Macerata (IT)

(72) Inventor: Ivan Teobaldelli, Macerata (IT)

( * ) Notice: Subject to any disclaimer, the term of this patent is extended or adjusted under 35 U.S.C. 154(b) by 0 days.

(21) Appl. No.: 16/073,925

(22) PCT Filed: Jan. 23, 2017

(86) PCT No.: PCT/EP2017/051281
§ 371 (c)(1),
(2) Date: Jul. 30, 2018

(87) PCT Pub. No.: WO2017/133911
PCT Pub. Date: Aug. 10, 2017

(65) Prior Publication Data

US 2019/0040603 A1 Feb. 7, 2019

(30) Foreign Application Priority Data

Feb. 4, 2016 (IT) ..... 102016000011806

(51) Int. Cl.
*E02D 27/34* (2006.01)
*E04B 1/98* (2006.01)
*E04H 9/02* (2006.01)

(52) U.S. Cl.
CPC ..... *E02D 27/34* (2013.01); *E04B 1/985* (2013.01); *E04H 9/021* (2013.01); *E02D 2250/0023* (2013.01); *E02D 2300/002* (2013.01); *E02D 2300/0006* (2013.01); *E02D 2300/0029* (2013.01)

(58) Field of Classification Search
CPC ..... E02D 27/34; E02D 2250/0023; E02D 2300/002; E02D 2300/0006; E02D 2300/0029; E04H 9/021; E04H 9/02; E04H 9/00; E04B 1/985
See application file for complete search history.

(56) References Cited

U.S. PATENT DOCUMENTS 6,062,770 A * 5/2000 Beck ..... E02D 27/48 405/184
2008/0253845 A1* 10/2008 Takeuchi ..... E02D 27/14 405/233
2015/0101263 A1* 4/2015 Price ..... E04B 1/34315 52/79.1

FOREIGN PATENT DOCUMENTS

CA 2415987 A1 * 3/2004 ..... E02D 27/34
SU 625012 A1 * 9/1978

* cited by examiner

*Primary Examiner* — Jessie T Fonseca
(74) *Attorney, Agent, or Firm* — Egbert, McDaniel & Swartz, PLLC

(57) ABSTRACT

A double raft foundation for buildings includes: a lower raft, a layer of a material with a low friction coefficient applied on the lower raft, a platform having slabs of material with a low friction coefficient, slidingly disposed on the layer, an upper raft joined with the slab platform and a superstructure joined with the upper raft; wherein the upper raft is disposed on the lower raft in such manner that, in case of an earthquake, the platform of slabs of the upper raft can slide slidingly on the layer of the lower raft, allowing the upper raft to move relatively with respect to the lower raft.

9 Claims, 5 Drawing Sheets

FOUNDATION

The present patent application for industrial invention relates to a double raft foundation.

Raft foundation is the most popular type of foundation that is currently used for buildings with small, medium and large size.

In the case of a building with 2-3 floors, after excavating the soil, lean concrete is cast for approximately 20 cm and a work surface is obtained. Then, a raft with a height of approximately 50-60 cm (for structures with 2-3 floors) is cast directly on the work surface made of lean concrete. Both the pillars and the load-bearing structure are built on the raft.

Evidently, during an earthquake, such a structure is subject to high stress that impairs the mechanical resistance of the structure.

At the moment, even if all building structures made by man are subject to the dynamic stress produced by an earthquake, only some of them are protected against earthquakes with various types of structural control devices. These devices can be classified in three categories:

- an active system designed to monitor the structure and apply forces to regulate the dynamic status of the structure;
- a semi-active system that limits the structure control to a dampener;
- a passive system that passively suffers the dynamic action of the earthquake.

The best solution is represented by the passive system, i.e. a system that is capable of seismically insulating the building in such manner not to transmit the seismic stress to the structure.

Various types of energy dissipators are currently known to protect a building structure from earthquakes. However, in order to work properly, the energy dissipators of known type must be applied to a heavy structure, i.e. reinforced concrete buildings with minimum four floors and maximum ten floors. Such energy dissipators do not work in case of light-weight wooden structures or reinforced concrete buildings with two or three floors.

FR2619589 discloses a double raft foundation for buildings comprising a lower raft and a bitumen sliding layer disposed inside the lower raft. A first bitumen plate is disposed onto the sliding layer and a second bitumen plate is disposed onto the first plate. An upper raft is joined to the first bitumen plate and to the second bitumen plate and a superstructure is joined to the upper raft. Given that the sliding layer of the lower raft is made of bitumen and also the plates joined to the upper raft are made of bitumen, the static and dynamic friction coefficient between the sliding layer and the plates is obviously very high. As it is known, the friction coefficient between bitumen and bitumen is approximately 0.5. Consequently, in case of earthquake, the sliding of the upper raft with respect to the lower raft is very reduced.

The purpose of the present invention is to eliminate the drawbacks of the prior art by providing a double raft foundation capable of seismically insulating the building structure.

Another purpose of the present invention is to provide such a double raft foundation that is suitable for being used in light-weight small-sized structures, thus minimizing the weight and the cost of the building structure.

An additional purpose of the present invention is to provide such a double raft foundation that is efficient and suitable for maintaining its structural characteristics unchanged over time, including after an earthquake.

These purposes are achieved according to the invention, with the characteristics claimed in the independent claim 1.

Advantageous embodiments of the invention appear from the dependent claims.

The double raft foundation of the invention has been devised to seismically insulate a light-weight building structure, for example a house with one or two floors, considering that in such a case the energy dissipators of the prior art are not effective.

The double raft foundation of the invention comprises:

- a lower raft,
- a layer of material with a low friction coefficient applied jointly on the lower raft,
- a platform comprising a plurality of coplanar slabs of material with a low friction coefficient, slidingly disposed on said layer with a low friction coefficient of the lower raft,
- an upper raft obtained jointly on said platform, and
- a superstructure joined to the upper raft.

The upper raft is disposed on the lower raft in such manner that, in case of an earthquake, said platform of the upper raft can slide slidingly on said layer with a low friction coefficient of the lower raft, allowing the upper raft to move relatively with respect to the lower raft.

Materials with a low friction coefficient are materials that when, upon mutual rubbing, have a static and dynamic sliding friction coefficient equal to or lower than the static ($\mu_{rs}$) and dynamic ($\mu_{rd}$) sliding friction coefficient in the case of Teflon-Steel, i.e. materials with $\mu_{rs} \leq 0.04$ and $\mu_{rd} \leq 0.04$.

Therefore, advantageously, the layer that covers the lower raft can be made of Teflon and the slabs of the platform can be made of steel.

The inventive idea of the present invention is the seismic shear in Teflon-steel or Teflon-Teflon made in association with any structure and climatic condition.

The double raft foundation of the invention has the following advantages:

- the superstructure motion is decoupled with respect to the ground and the upper raft is decoupled with respect to the lower raft, limiting the quantity of incoming seismic energy and avoiding damage to the superstructure on the upper raft, to the understructure under the lower raft and to the Teflon-steel or Teflon-Teflon insulation device;
- the superstructure mounted on the upper raft is leaner because it withstands smaller forces and is therefore cheaper, thus making it possible to insulate light-weight structures;
- the cost of the Teflon slabs is limited and much lower than any other type of passive dissipation systems;
- the incoming seismic energy is dissipated with suitable dampers and the stricture is self-recentered;
- no maintenance is required and efficiency is maintained after each seism and for the entire lifetime of the superstructure;
- the thickness of the Teflon-steel sliding system is reduced to two centimeters (or even less) and the sliding system is easy to install and rapid to execute;
- the sliding surface is made of self-lubricating material (Teflon) that does not stick to any material;
- the sliding surface guarantees cold resistance down to −260° C., heat resistance up to +260° C., as well as resistance to acids and fire;
- the sliding surface guarantees electrical and thermal insulation.

Additional characteristics of the invention will become more fully apparent from the following description, which refers to merely exemplary, not limiting embodiments, which are illustrated in the attached technical drawings, wherein.

Figure 1:
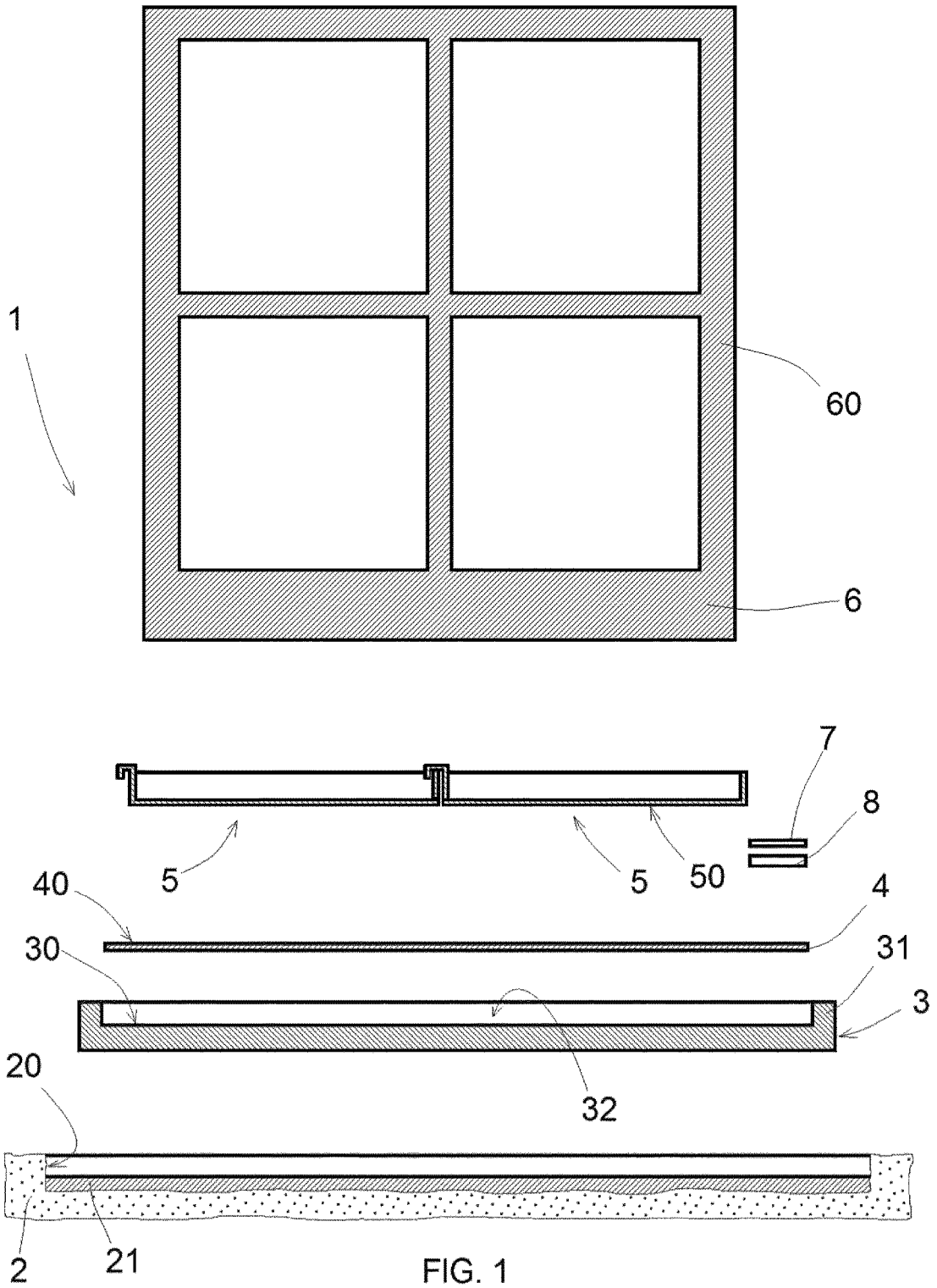
FIG. 1 is an exploded sectional view of the various parts of the double raft foundation according to the invention.

Referring to the figures, the double raft foundation of the invention is disclosed, being generally indicated with reference numeral (1).

Figure 2:
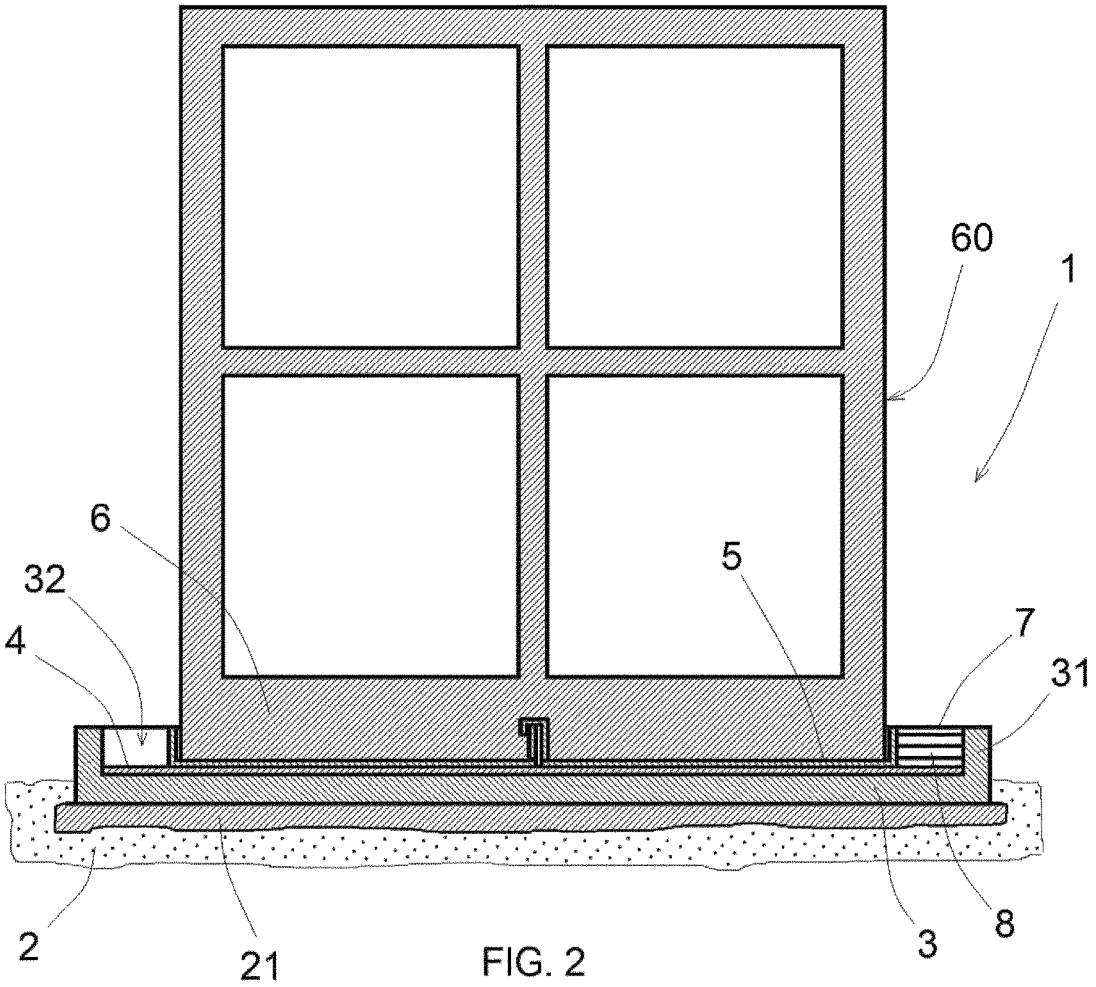
FIG. 2 is a sectional view of the foundation of FIG. 1 in assembled condition.

With reference to FIGS. 1 and 2, in order to install the double raft foundation (1) according to the present invention, an excavation (20) of the soil (2) is made and lean concrete (21) is cast in the excavation (20), just like in the construction systems that are currently used.

Then, a lower raft (3) of reinforced concrete is made on the lean concrete (21); for instance, in the case of a house with 2-3 floors, the lower raft has a thickness of approximately 30-40 cm. The upper surface (30) of the lower raft (3) is smooth, planar and leveled. Advantageously, a smoothing material, such as cement mortar, is applied on the upper surface (30) of the lower raft to repair the non-uniformities that may be generated when casting the lean concrete (21).

Advantageously, the lower raft (3) can be shaped as a tank with perimeter walls (31) that are raised with respect to the upper surface (30) of the lower raft, in such manner to define a recessed housing (32).

A layer of material with a low friction coefficient, preferably a layer of Teflon (4) with thickness of 1-10 cm, is laid and fixed on the upper surface (30) of the lower raft. The Teflon layer (4) must have a constant thickness and an upper surface (40) that is as uniform as possible. Advantageously, the layer of material with a low friction coefficient may comprise a mix of Teflon and carbon in order to obtain a better sliding and a longer life of the layer of material with a low friction coefficient.

A plurality of slabs (5) forming a platform is disposed on the Teflon layer. The slabs (5) are made of a material with a low friction coefficient, such as steel and/or Teflon.

Advantageously, the slabs (5) are made of steel and have a minimum thickness of 1-2 mm. In this way the steel of the slabs (5) is in direct contact with the Teflon layer (4) and the slabs (5) can slide on the Teflon layer (4). Advantageously, the slabs (5) may be of steel and may have a Teflon-coated lower surface (50). In this way the Teflon surface of the slab (5) comes in contact with the Teflon layer (4), thus minimizing the friction between the Teflon layer (4) and the slab (5). The slab (5) can be made of Teflon only.

Figure 3:
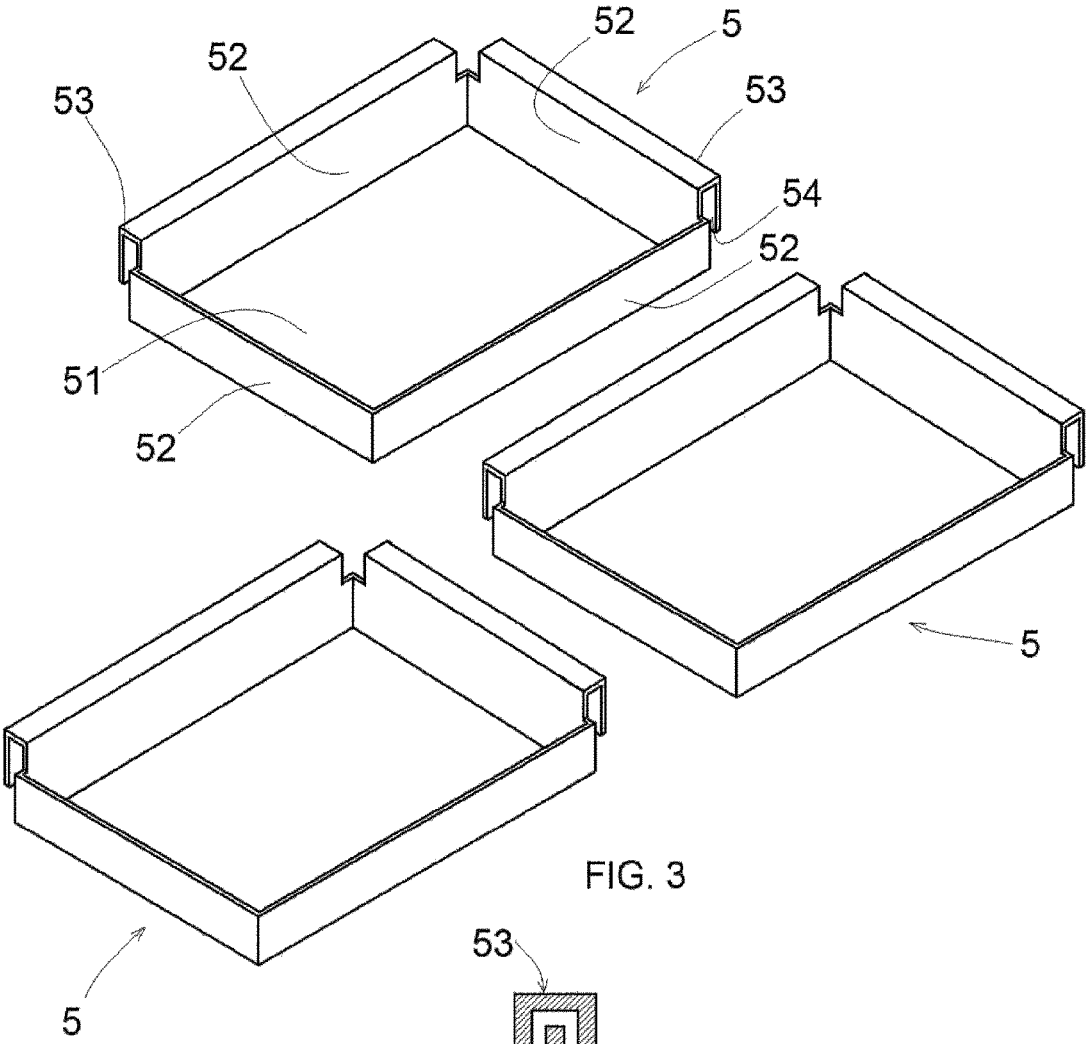
FIG. 3 is an exploded perspective view of three slabs of the upper raft of the foundation according to the present invention.
Figure 4:
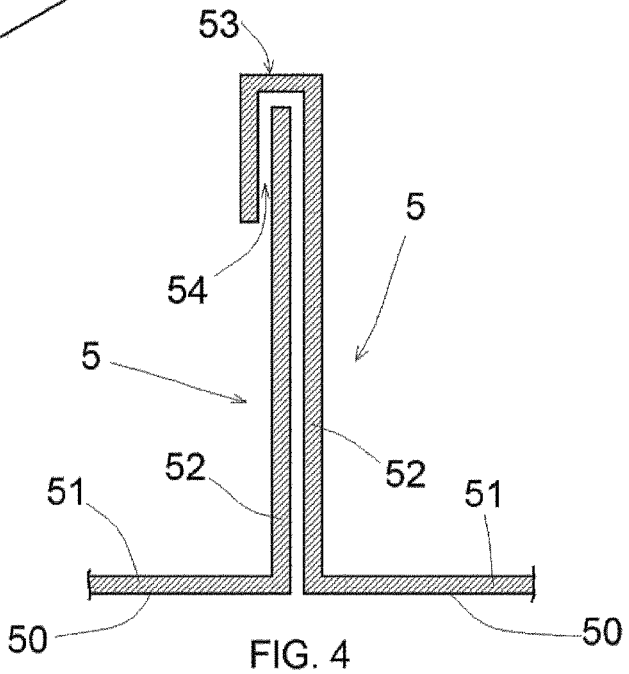
FIG. 4 is partially interrupted sectional view that shows the assembly of two slabs of FIG. 3.

Referring to FIGS. 3 and 4, each steel slab (5) is shaped as a rectangular tank provided with a bottom wall (51) and four side walls (52) orthogonally raising from the bottom wall for a height of approximately 2-4 cm.

Two adjacent side walls (52) of a steel slab have a downward U-bent upper edge (53) in such manner to define housing (54) that is open on the bottom. In this way a second slab (5) can be assembled to a first slab (5) that is already laid on the Teflon layer (4), by fitting the upper border of a side wall (52) of the first slab inside the housing (54) of the upper edge of the second slab, in such manner to form a joint between the two slabs and create a single steel surface between the two slabs. In view of the above, the platform is made of a modular structure comprising a plurality of interconnected steel slabs (5).

After assembling the slabs (5), the joints between the slabs are sealed with gaffer tape (not shown in the figures) to prevent the concrete from falling on the Teflon layer (40). Now, having obtained a sealed steel surface, an upper raft (6) is made.

Firstly, steel girders (not shown in the figures) are built on the slabs (5) and then concrete is cast on the slabs (5) in such manner to form the upper raft (6) of reinforced concrete with thickness of approximately 30-40 cm (for houses with 2-3 floors). The upper raft (6) must have surface dimensions (length and width) that are lower than the surface dimensions of the Teflon layer (4) cast on the lower raft (3) in order to make sliding on said Teflon layer (4) possible. For example, the upper raft (6) is centered in the recessed housing (32) of the lower raft (3), leaving a clearance of about 30-50 centimeters between the upper raft and the side walls (31) of the lower raft.

The upper raft (6) is joined to a superstructure (60) that can be provided with one or more housing modules, for instance.

The bottom of the upper raft (6) is the platform composed of the slabs (5) resting on the Teflon layer (4). Considering that the friction of steel on Teflon is similar to the friction on ice, a superstructure (60) that slides on the lower raft (3) with practically no friction is obtained.

The lower raft (3) must be wider than the upper raft (6) to allow for sliding and must have a peripheral raised curb composed of the side walls (31) to prevent the upper raft (6) from coming out of the lower raft (3). Moreover, such a configuration allows for using a dampening system (7) to dampen the sliding of the upper raft (6) and a centering system (8) to center the upper raft (6) with respect to the lower raft (3) when the earthquake is finished. The dampening system (7) and the centering system (8) are interposed between the perimeter walls (71) of the lower raft (3) and the upper raft (6).

Advantageously, the lower raft (3) can be much wider than the upper raft (6). In such a case, the use of dissipating devices and centering devices is not necessary because the upper raft (6) can be centered with respect to the lower raft (3) by means of a jack when the earthquake is finished. This system can be advantageously applied in areas with low seismic hazard in order to reduce costs.

Steel is chosen as friction surface for the upper raft for merely economic reasons. An additional Teflon layer can be used as sliding surface for the upper raft in case of double raft foundations in very cold, very warm, acid and aggressive places, or for special requirements of factories, etc. The sliding between Teflon-Teflon has the same friction as steel-Teflon, both being proximal to the sliding produced between steel and ice.

As an alternative to reinforced concrete, the upper raft (6) and the superstructure (60) joined to the upper raft can be made of another material, such as wood, steel, bricks or stone.

It must be considered that in the double raft foundation (1) the operating thickness is limited to a total of approximately 2 cm, 1 centimeter for the Teflon layer (4) of the lower raft and 1 centimeter for the steel slab (5) of the upper raft.

Figure 5:
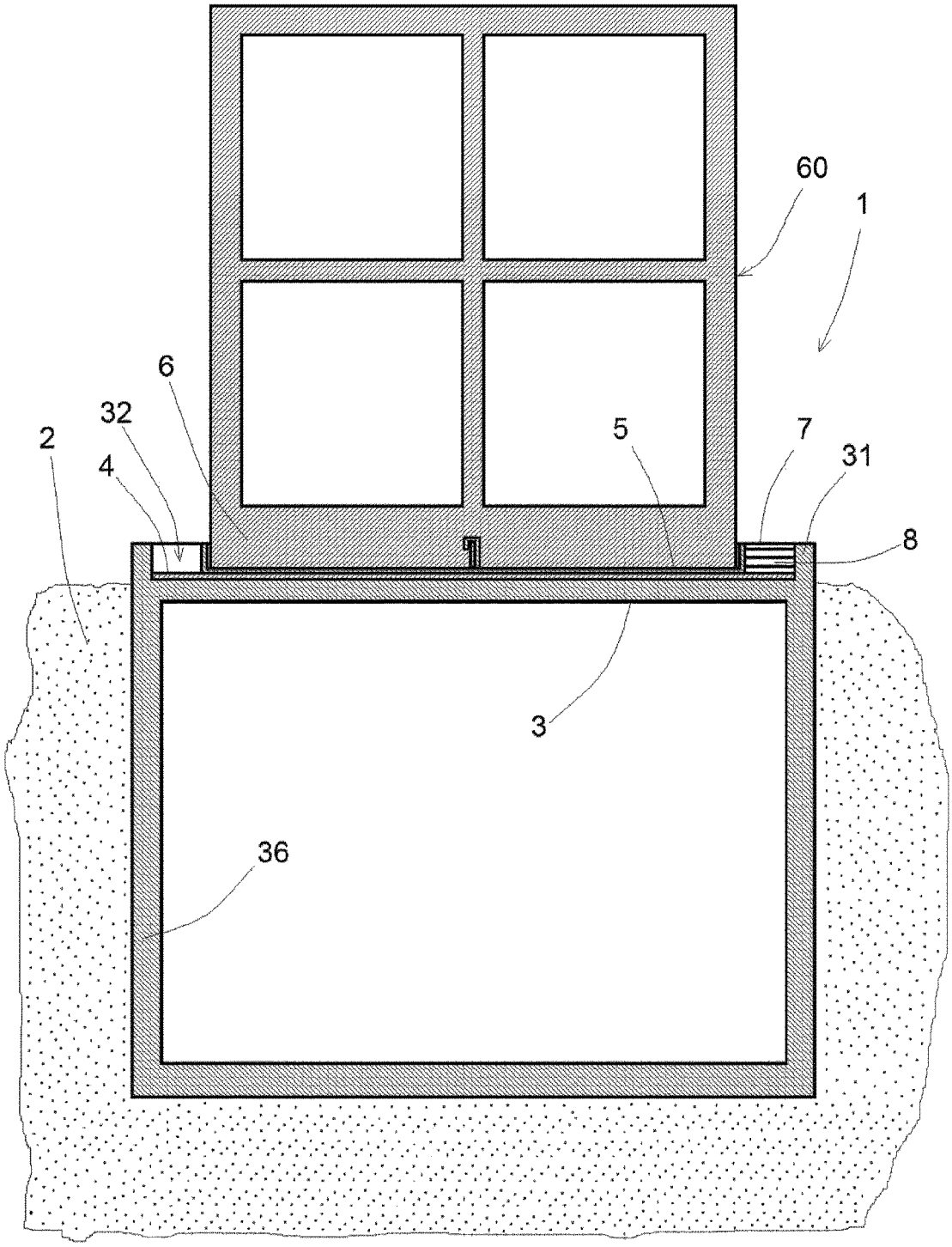
FIG. 5 is a sectional view of a building with a buried understructure and a superelevated structure.

With reference to FIG. 5, in case of a building with two or three off-ground floors and one underground floor used as garage, the underground floor (understructure (36)) could be typically made with reinforced concrete, thus joining it to the lower raft (3). Instead, the off-ground floors (superstructure (60)) are joined to the upper raft (6). In this way, the seismic shear is made at the height of the ground floor. This will make the building works easier and will reduce the building costs. For example, the understructure (36) and the lower raft (3) are made of reinforced concrete and the superstructure (60) is made of wood.

Always considering the limited thickness that is needed for the operation of the double raft foundation according to the invention, new actions are possible for skyscrapers.

Figure 6:
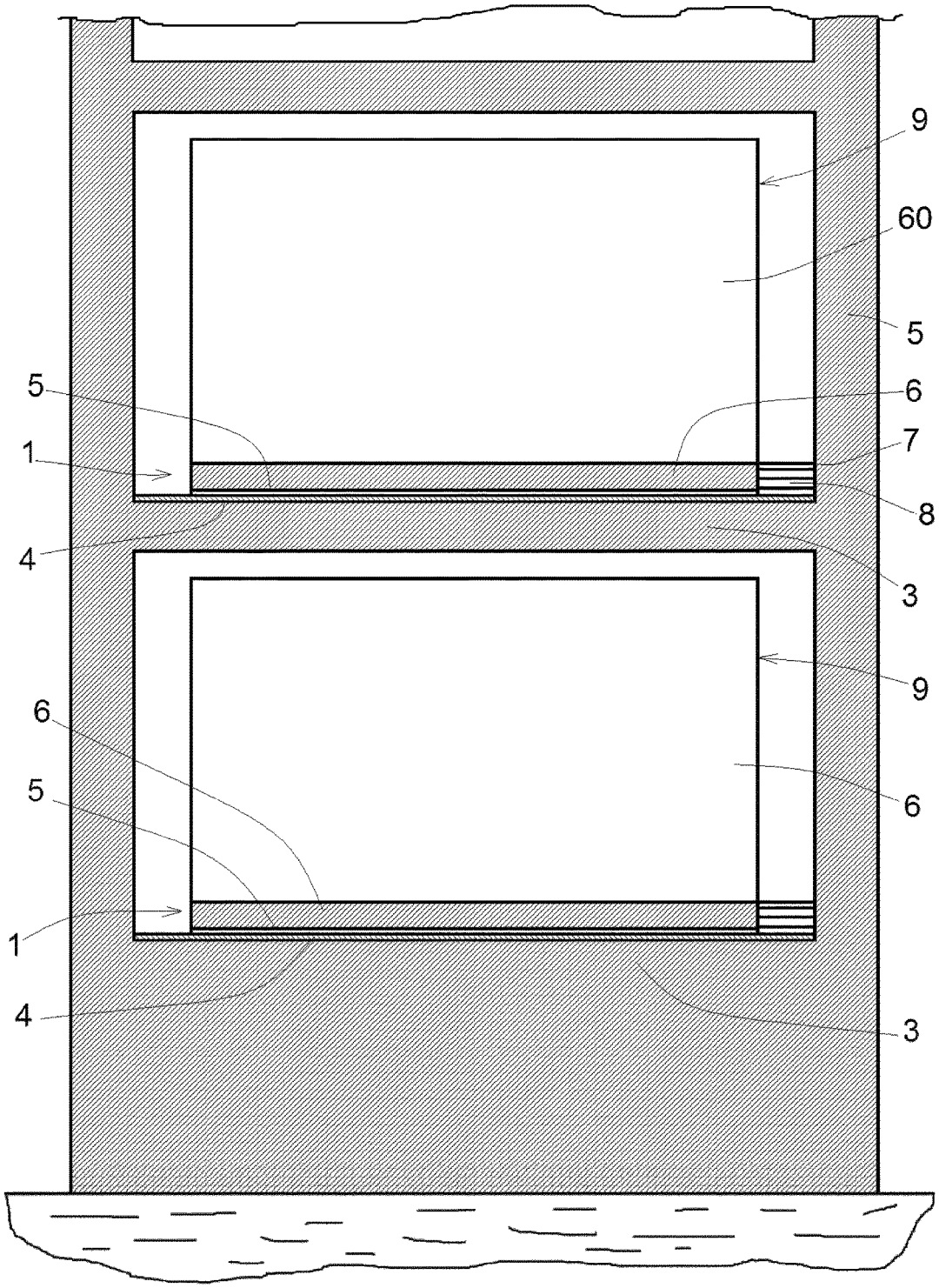
FIG. 6 is a sectional view of a skyscraper wherein each housing module is made with a double raft foundation according to the present invention.

With reference to FIG. 6, the upper raft (6) and the superstructure (60) joined to the upper raft form a prefabricated module (9) separated from the load-bearing structure (S) of the skyscraper. The floors of the skyscraper form the lower rafts (3). A Teflon layer (4) with 1 cm thickness is applied jointly on the lower rafts (3) composed of the skyscraper floors. A platform comprising Teflon slabs (5) with 1 cm thickness is applied jointly under the upper raft (6) composed of the base of the prefabricated module (9). In this way, the prefabricated modules (9) are disposed in the load-bearing structure (S) of the skyscraper with the double raft foundation system.

Dissipating devices (7) and centering devices (8) are interposed between the load-bearing structure (S) of the skyscraper and the upper raft (6) composed of the base of the prefabricated module (9).

In this way the skyscraper will have prefabricated modules (9) that behave differently on each floor, progressively going upwards. The entire load-bearing structure (S) of the skyscraper will be less stressed during the seism. The seismic movement of the load-bearing structure (S) corresponds to a movement of the prefabricated modules that slide on the floors of the load-bearing structure (S).

Numerous variations and modifications can be made to the present embodiments of the invention, within the reach of an expert of the field, while still falling within the scope of the invention.

The invention claimed is:

1. A double raft foundation for buildings, the double raft foundation comprising:

a lower raft;

a layer of material applied to said lower raft;

a platform having a plurality of coplanar slabs slidingly disposed on said layer of material on said lower raft;

an upper raft joined to said platform; and a superstructure joined to said upper raft, wherein said upper raft is disposed on said lower raft such that said platform can slide on said layer of material on said lower raft so as to allow said upper raft to move relative to said lower raft in an event of an earthquake, a static sliding friction coefficient and a dynamic sliding friction coefficient between said layer of said material on said lower raft and said plurality of coplanar slabs joined to said upper raft are equal to or less than 0.04.

2. The double raft foundation of claim 1, wherein said layer of the material is polytetraflouroethylene and said plurality of coplanar slabs of said platform raft are made of steel or polytetraflouroethylene.

3. The double raft foundation of claim 1, wherein said lower raft is a tank with raised perimeter walls and configured to contain said upper raft.

4. The double raft foundation of claim 3, further comprising:

dissipating-dampening devices and centering devices interposed between the perimeter walls of said lower raft and said upper raft to dampen said movement of said upper raft and to center said upper raft with respect to said lower raft after the earthquake.

5. The double raft foundation of claim 1, wherein said layer of material on said lower raft is a layer of polytetraflouroethylene with a thickness of approximately one centimeter to two centimeters.

6. The double raft foundation of claim 1, wherein each slab of said plurality of coplanar slabs of said platform is a rectangular tank with side walls protruding upwardly of said plurality of coplanar slabs from a bottom wall.

7. The double raft foundation of claim 6, wherein each slab has at least one side wall with U-bent upper edges so as to define a housing that receives an upper border of the side wall of an adjacent slab of said plurality of coplanar slabs.

8. The double raft foundation of claim 1, further comprising:

an understructure that extends under said lower raft and is joined to said lower raft.

9. The double raft foundation of claim 8, wherein said superstructure joined to said upper raft so as to as to form a prefabricated module separated from a load-bearing structure of a skyscraper, wherein said lower raft is a floor of the skyscraper and the prefabricated module is positioned on the floor of the skyscraper.

* * * * *